US012320571B2

(12) United States Patent
Chhajed et al.

(10) Patent No.: US 12,320,571 B2
(45) Date of Patent: Jun. 3, 2025

(54) THERMAL IMPROVEMENTS IN VIS REFRIGERATORS

(71) Applicant: WHIRLPOOL CORPORATION, Benton Harbor, MI (US)

(72) Inventors: Rahul Subhash Chhajed, Stevensville, MI (US); Sumedh Sanjay Kokane, Maharashtra (IN); Subrata Shannigrahi, St. Joseph, MI (US); Abinash Sarma, Assam (IN)

(73) Assignee: Whirlpool Corporation, Benton Harbor, MI (US)

( * ) Notice: Subject to any disclaimer, the term of this patent is extended or adjusted under 35 U.S.C. 154(b) by 165 days.

(21) Appl. No.: 18/132,580

(22) Filed: Apr. 10, 2023

(65) Prior Publication Data

US 2024/0337429 A1 Oct. 10, 2024

(51) Int. Cl.
*F25D 11/02* (2006.01)
*F25D 23/06* (2006.01)

(52) U.S. Cl.
CPC ..... *F25D 11/02* (2013.01); *F25D 23/063* (2013.01); *F25D 2201/14* (2013.01)

(58) Field of Classification Search
CPC ..... F25D 11/02; F25D 11/022; F25D 23/063; F25D 23/066; F25D 23/069; F25D 2201/14; F25D 2400/04; F25D 21/04; F25D 19/00
See application file for complete search history.

(56) References Cited

U.S. PATENT DOCUMENTS

| | | | | |
|---|---|---|---|---|
| 3,263,440 | A | 8/1966 | Hellstrom | |
| 10,088,216 | B2 | 10/2018 | Chae et al. | |
| 11,098,944 | B2 | 8/2021 | Shin et al. | |
| 11,149,995 | B2 | 10/2021 | Jung et al. | |
| 11,408,663 | B2 | 8/2022 | Cho et al. | |
| 2006/0266075 | A1* | 11/2006 | Itsuki | F25B 40/00 62/512 |
| 2007/0214824 | A1 | 9/2007 | Itsuki | |
| 2011/0011119 | A1* | 1/2011 | Kuehl | F25D 16/00 62/498 |

(Continued)

FOREIGN PATENT DOCUMENTS

| | | | |
|---|---|---|---|
| CN | 101865591 | A | 10/2010 |
| CN | 216204550 | U | 4/2022 |

(Continued)

*Primary Examiner* — Emmanuel E Duke
(74) *Attorney, Agent, or Firm* — Price Heneveld LLP

(57) ABSTRACT

A refrigeration appliance includes a cabinet having a trim breaker defining a mullion region and a refrigerant system. The cabinet defines a first compartment and a second compartment. The refrigerant system includes a refrigerant defining a flow path through a compressor, a heat loop coupled to the compressor, a condenser coupled to the heat loop, and an evaporator assembly coupled to the compressor and the condenser. The heat loop is routed around a perimeter of the cabinet and through the mullion region. The evaporator assembly includes at least one first evaporator disposed in the first compartment and a second evaporator disposed in the second compartment. The at least one first evaporator may include a first roll bond evaporator coupled to a second roll bond evaporator in series with the first, or a wire-on-tube evaporator.

20 Claims, 13 Drawing Sheets

(56) References Cited

U.S. PATENT DOCUMENTS

| | | | | |
|---|---|---|---|---|
| 2013/0061620 | A1* | 3/2013 | Li | F25D 11/022 62/126 |
| 2021/0207878 | A1* | 7/2021 | Deka | F25D 23/085 |
| 2021/0325106 | A1* | 10/2021 | Marinello | F25D 23/085 |
| 2022/0090831 | A1 | 3/2022 | Chhajed et al. | |

FOREIGN PATENT DOCUMENTS

| | | | | |
|---|---|---|---|---|
| CN | 217604437 | U | 10/2022 | |
| DE | 19957719 | A1 * | 5/2001 | F25B 5/02 |
| EP | 1042638 | B1 | 5/2002 | |
| EP | 1712857 | A2 | 10/2006 | |
| EP | 3458784 | B1 | 2/2020 | |
| JP | 2014134379 | A | 7/2014 | |
| KR | 100594420 | B1 | 7/2006 | |
| WO | WO-2018022006 | A1 * | 2/2018 | F25D 23/028 |
| WO | WO-2019108204 | A1 * | 6/2019 | F25D 21/04 |
| WO | 2019202683 | A1 | 10/2019 | |

* cited by examiner

THERMAL IMPROVEMENTS IN VIS REFRIGERATORS

BACKGROUND OF THE DISCLOSURE

The present disclosure generally relates to thermal improvement for an appliance, and more specifically, to thermal improvements for a vacuum insulated refrigeration appliance.

SUMMARY OF THE DISCLOSURE

According to one aspect of the present disclosure, a vacuum insulated refrigerator includes a cabinet defining a refrigerator compartment and a freezer compartment where the cabinet at least partially defines a mechanical compartment. The cabinet includes a liner, a wrapper, and a trim breaker. The trim breaker is coupled to the liner and the wrapper. The trim breaker defines a refrigerator compartment perimeter, a freezer compartment perimeter, and a mullion region between the refrigerator compartment and the freezer compartment. The refrigerant system includes a compressor disposed in the mechanical compartment. A heat loop is coupled to the compressor where the heat loop includes a first send segment routed from the mechanical compartment and along a first portion of the freezer compartment perimeter, a second send segment routed through the mullion region, and a third send segment routed along a first portion of the refrigerator compartment perimeter adjacent the mullion region. A first return segment is routed along a second portion of the refrigerator compartment perimeter, a second return segment is routed through the mullion region, and a third return segment is routed along a second portion of the freezer compartment perimeter and to the mechanical compartment. A condenser is disposed in the mechanical compartment and is coupled to the heat loop, where a refrigerant is directed from the compressor, through the heat loop, and then to the condenser, and an evaporator assembly is coupled to the condenser and the compressor.

According to another aspect of the present disclosure, a vacuum insulated refrigerator includes a cabinet defining an upper compartment, a lower compartment, and a mullion region between the upper compartment and the lower compartment. The cabinet at least partially defines a machine compartment. A trim breaker is coupled to a periphery of the cabinet and the mullion region. A compressor is disposed in the machine compartment. A heat loop is fluidly coupled to the compressor where the heat loop is coupled to the trim breaker and is routed along the periphery of the cabinet and through the mullion region. A condenser is fluidly coupled to the heat loop. An evaporator assembly is fluidly coupled to the condenser and to the compressor. The evaporator assembly includes at least one first evaporator disposed in the upper compartment and a second evaporator disposed in the lower compartment. A refrigerant is configured to flow from the compressor to the heat loop, from the heat loop to the condenser, and from the condenser to the evaporator assembly.

According to yet another aspect of the present disclosure, a refrigeration appliance includes a cabinet including a wrapper and a liner where the wrapper at least partially defines a machine compartment. A trim breaker is coupled to an edge of the wrapper and an edge of the liner. The trim breaker defines a mullion region. A refrigerant system includes a compressor disposed in the machine compartment. A heat loop is coupled to the compressor. The heat loop is coupled to the trim breaker. The heat loop includes a send portion and a return portion routed through the mullion region, where the send portion and the return portion each cross a center line defined by the cabinet. A condenser is disposed in the machine compartment and is coupled to the heat loop. An evaporator assembly is coupled to the cabinet.

These and other features, advantages, and objects of the present disclosure will be further understood and appreciated by those skilled in the art by reference to the following specification, claims, and appended drawings.

Figure 1:
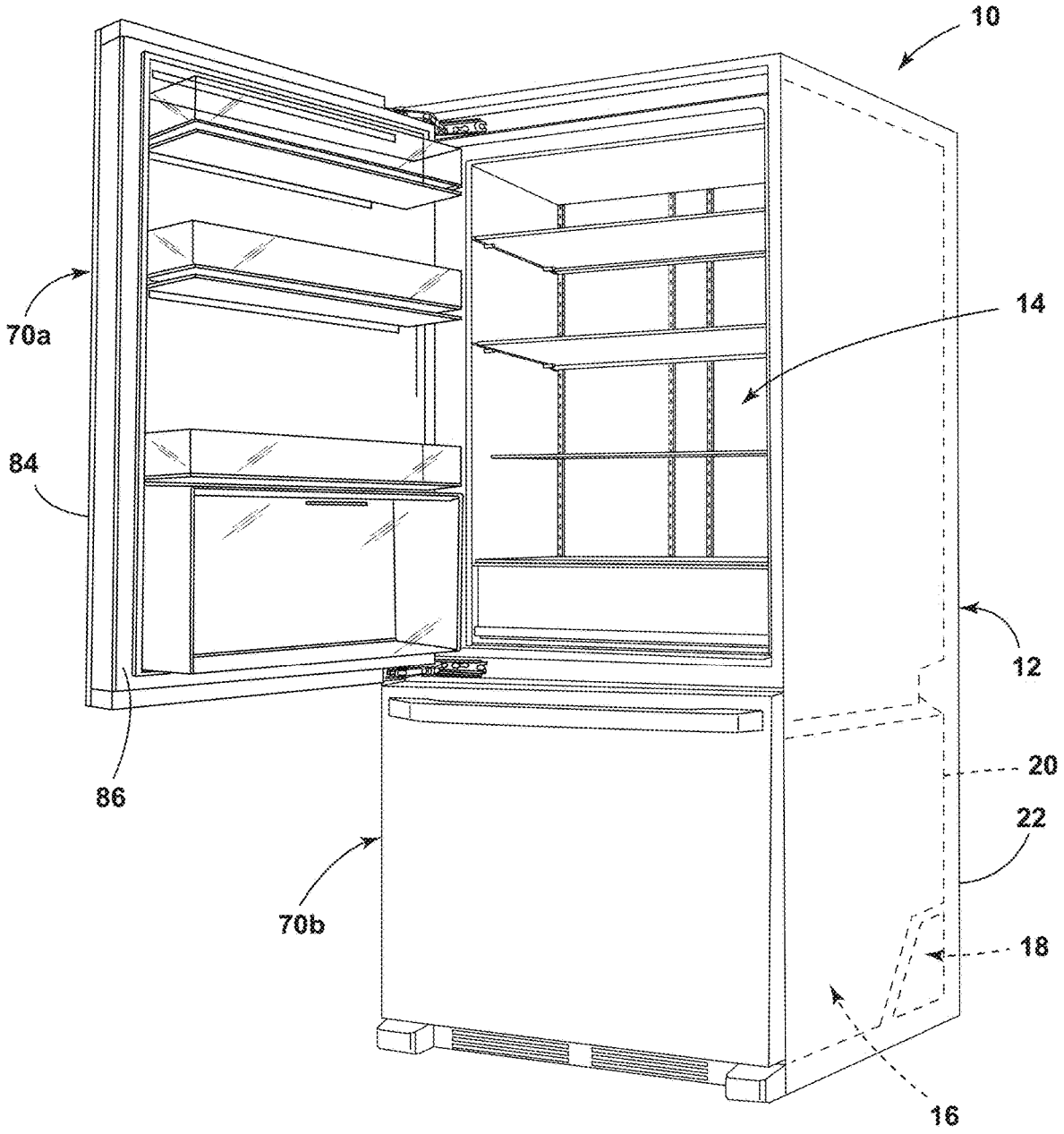
FIG. 1 is a front perspective of a refrigeration appliance, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to thermal improvements for a refrigeration appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-13, reference numeral 10 generally designates a vacuum insulated appliance including a cabinet 12 defining a refrigerator compartment 14 and a freezer compartment 16. The cabinet 12 at least partially defines a mechanical compartment 18 and includes a liner 20, a wrapper 22, and a trim breaker 24 coupled to the liner 20 and the wrapper 22. The trim breaker 24 defines a refrigerator compartment perimeter 26, a freezer compartment perimeter 28, and a mullion region 30 between the refrigerator compartment 14 and the freezer compartment 16. A refrigerant system 40 includes a compressor 42 disposed in the mechanical compartment 18, a heat loop 44 coupled to the compressor 42, a condenser 46 disposed in the mechanical compartment 18 and coupled to the heat loop 44, and an evaporator assembly 48 coupled to the condenser 46 and the compressor 42, where a refrigerant 49 is directed from the compressor 42, through the heat loop 44, and then to the condenser 46. The heat loop 44 includes a first send segment 50 routed from the mechanical compartment 18 and along a first portion 52 of the freezer compartment perimeter 28, a second send segment 54 routed through the mullion region 30, a third send segment 56 routed along a first portion 58 of the refrigerator compartment perimeter 26, a first return segment 60 routed along a second portion 62 of the refrigerator compartment perimeter 26, a second return segment 64 routed through the mullion region 30, and a third return segment 66 routed along a second portion 68 of the freezer compartment perimeter 28 and to the mechanical compartment 18.

Figure 2:
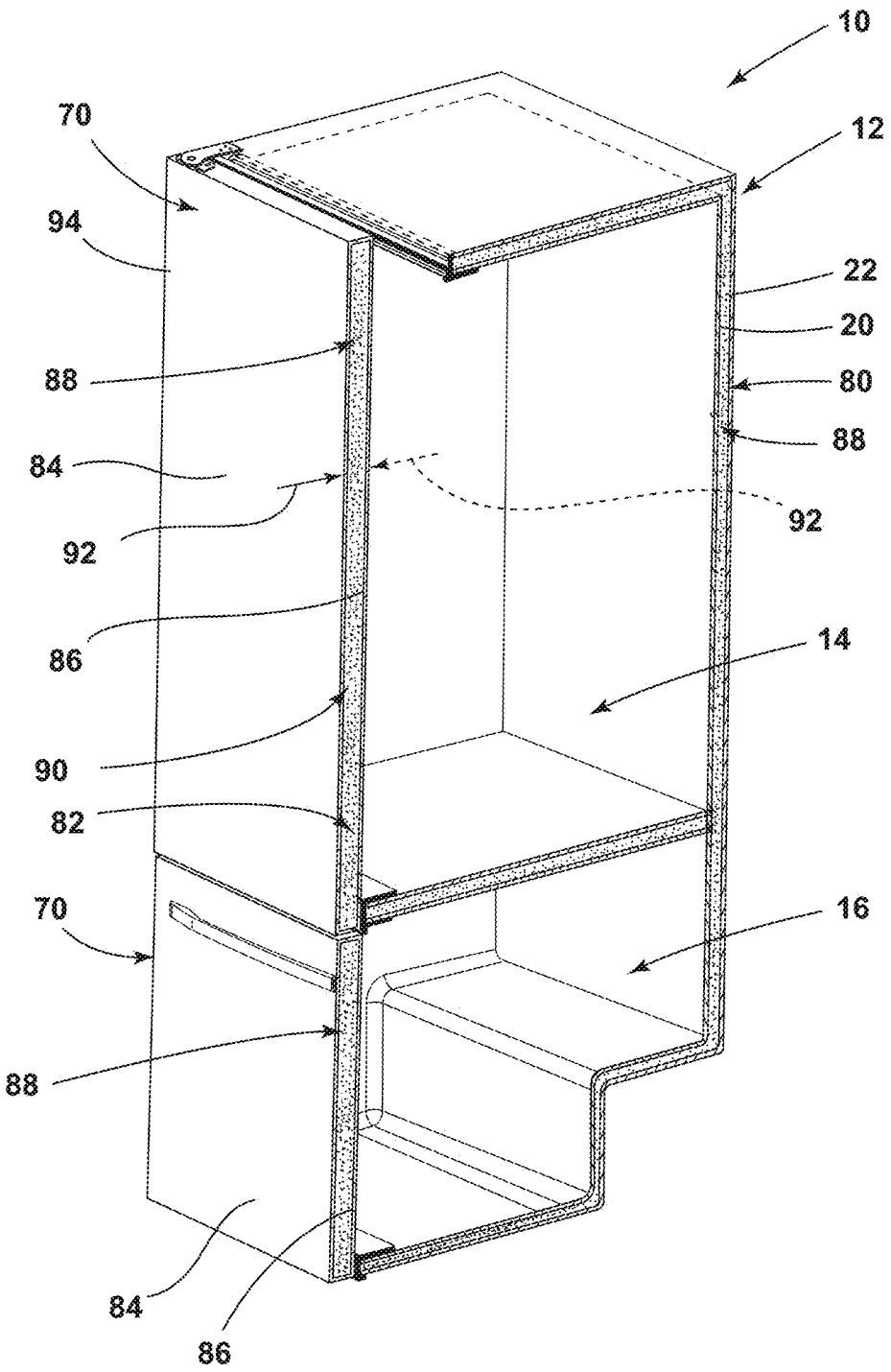
FIG. 2 is a cross-sectional view of a refrigeration appliance with a vacuum insulated cabinet and vacuum insulated doors, according to the present disclosure.
Figure 3:
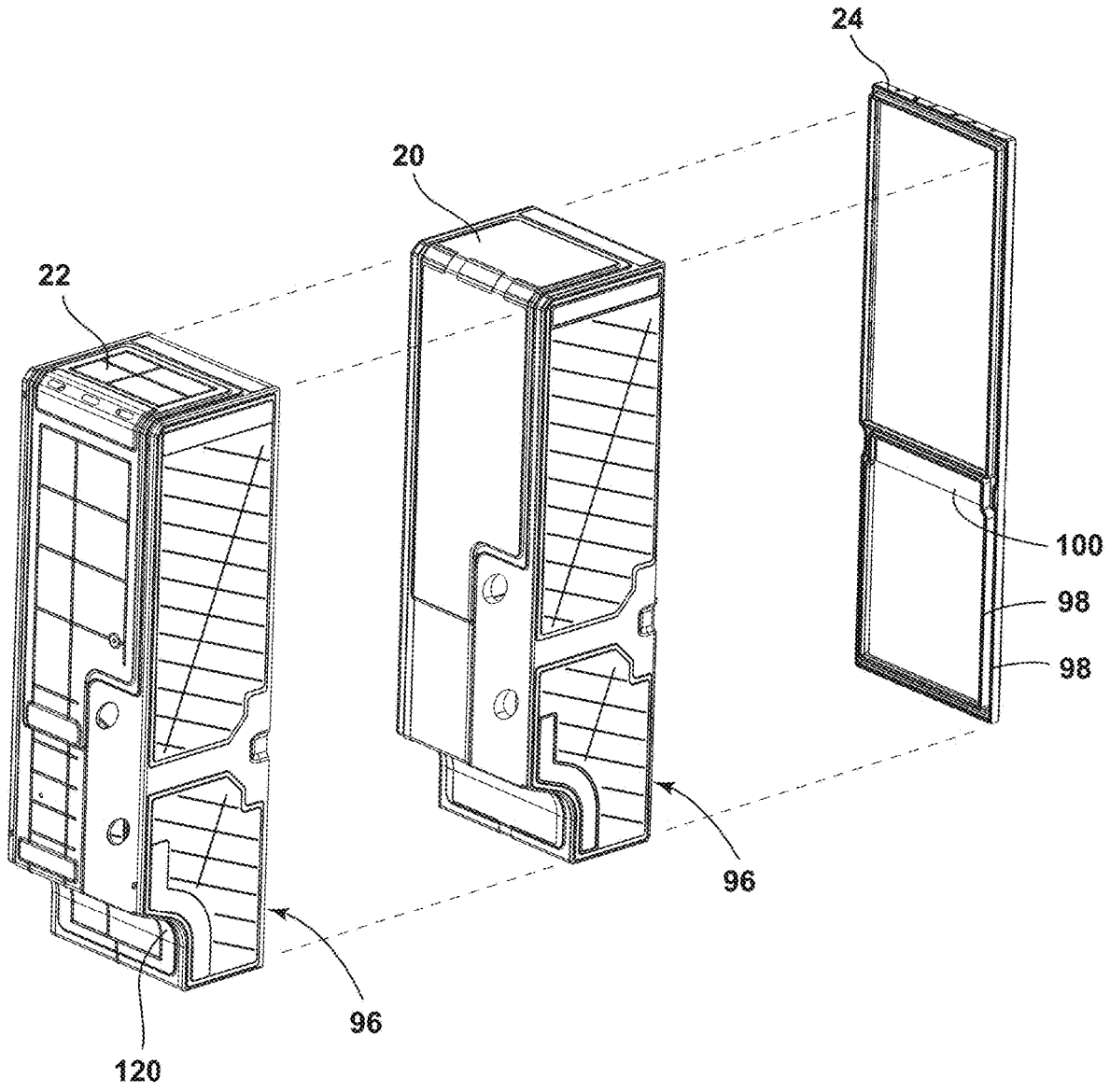
FIG. 3 is an exploded side perspective view of a cabinet for a refrigeration appliance with a wrapper, a liner, and a trim breaker, according to the present disclosure.

Referring to FIGS. 1-3, the vacuum insulated appliance 10 is illustrated as a refrigeration appliance, however, it is contemplated that the vacuum insulated appliance 10 disclosed herein may be for a variety of appliances, structures, or for insulation purposes other than with an appliance. The refrigeration appliance 10 is illustrated as a bottom mount refrigerator having a first insulated door 70*a* and a second insulated door 70*b*. The first insulated door 70*a* and the second insulated door 70*b*, which can generally be referred to as insulated doors 70, can have substantially similar configurations, as discussed further herein. The cabinet 12 of the illustrated refrigeration appliance 10 includes an upper compartment configured as the refrigerator compartment 14 and a lower compartment configured as the freezer compartment 16. In this way, the refrigerator and freezer compartments 14, 16 defined by the cabinet 12 can be sealed with the insulated doors 70*a*, 70*b*, respectively. Moreover, in various configurations, the appliance 10 may include the cabinet 12 defining at least a first compartment and a second compartment sealed with insulated doors 70. The appliance 10 may be, for example, a bottom mount French door refrigerator, a top mount refrigerator, a side-by-side refrigerator, a 4-door French door refrigerator, and/or a 5-door French door refrigerator. Further, the present disclosure is not limited to refrigerators. The appliance 10 may be, for example, freezers, coolers, vacuum insulated structures, and other similar appliances and fixtures within household and commercial settings.

The cabinet 12 of the appliance 10 is an insulated structure having an insulation cavity 80 defined between the liner 20 and the wrapper 22. Similarly, the insulated doors 70 are an insulated structure having an insulation cavity 82 defined between a door wrapper 84 coupled to a door liner 86. Each of the insulation cavities 80, 82 of the cabinet 12 and insulated doors 70 typically includes one or more insulation materials 88 disposed therein. It is generally contemplated that the insulation materials 88 may be glass type materials, carbon-based powders, silicon oxide-based materials, silica-based materials, insulating gasses, and other standard insulation materials 88 known in the art. The insulation materials 88 substantially fill the insulation cavity 80, forming a substantially continuous layer between the wrapper 22 and the liner 20. Similarly, the insulation materials 88 substantially fill the insulation cavity 82, forming a substantially continuous layer between the door wrapper 84 and the door liner 86. The insulation cavities 80, 82 are filled with the insulation materials 88 using a load port on the cabinet 12 and the insulated doors 70, respectively. The cabinet 12 and the insulated doors 70 each define an evacuation port for applying a vacuum or negative pressure to the insulation cavities 80, 82.

Referring still to FIGS. 1-3, an at least partial vacuum 90 is defined within the insulation cavities 80, 82. The at least partial vacuum 90 defines a pressure differential 92 between an exterior 94 of the cabinet 12 and the insulation cavity 80. The pressure differential 92 serves to define the inward compressive force that is exerted on both the wrapper 22 and the liner 20 and tends to bias the wrapper 22 and the liner 20 toward the insulation cavity 80. The pressure differential 92 and the inward compressive force are also exerted on both the door wrapper 84 and the door liner 86 of the insulated doors 70 and tend to bias the door wrapper 84 and the door liner 86 towards the insulation cavity 82 in a similar manner.

The wrapper 22, the door wrapper 84, the liner 20, and the door liner 86 are made from a material at least partially resistant to bending, deformation, or otherwise being formed in response to an inward compressive force. These materials for the wrapper 22, the door wrapper 84, the liner 20, and the door liner 86 include, but are not limited to, metals, polymers, metal alloys, combinations thereof, and/or other similar substantially rigid materials that can be used for vacuum insulated appliances and structures.

Figure 4:
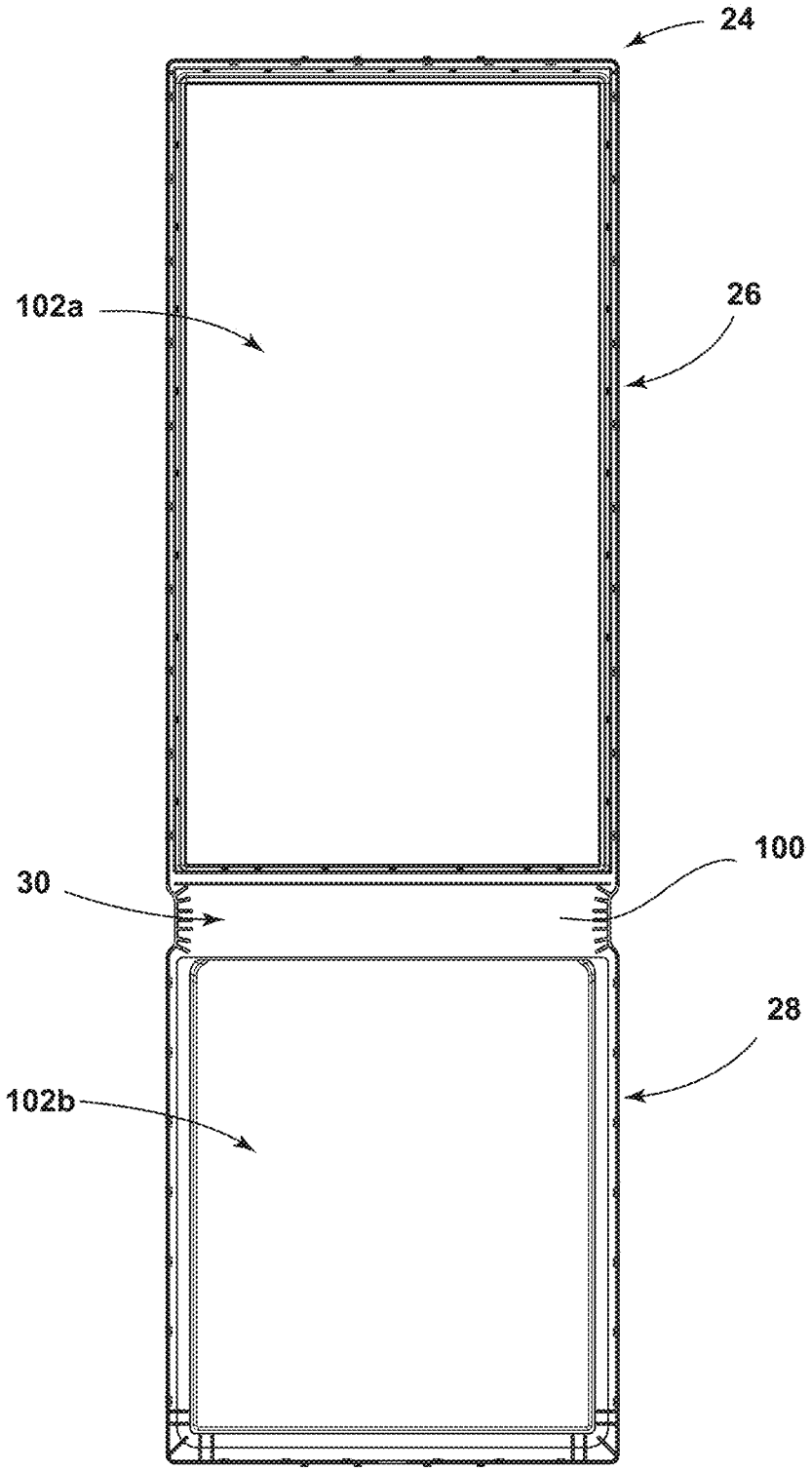
FIG. 4 is a front elevational view of the trim breaker of FIG. 3, according to the present disclosure.

Referring still to FIG. 3, as well as FIG. 4, it is contemplated that the trim breaker 24 may be coupled to the outer edges 96 of the wrapper 22 and/or the liner 20. The trim breaker 24 has a generally rectangular shape, however, it is contemplated that other geometric shapes known in the art may be used. In this way, the trim breaker 24 may not substantially interfere with access to the refrigerator and freezer compartments 14, 16 defined by the cabinet 12. At least one channel 98 may be defined around a perimeter of the trim breaker 24. The channel 98 may be configured to receive the outer edges 96 of the wrapper 22 and/or the liner 20. It is also contemplated that the trim breaker 24 may define more than one channel 98 to accommodate the wrapper 22 and the liner 20 in separate channels 98. The channels 98 may be filled with an adhesive, such as, for example, an epoxy. The adhesive is configured to couple the wrapper 22 and/or the liner 20 with the trim breaker 24 and seal the insulation cavity 80.

The trim breaker 24 includes cross member 100 to define apertures 102*a*, 102*b* corresponding to the refrigerator and freezer compartments 14, 16 of the appliance 10. The channels 98 defined by the trim breaker 24 may extend around the perimeter of the trim breaker 24 as well as along the cross member 100. The cross member 100 defines the mullion region 30 between the refrigerator and freezer compartments 14, 16. In the illustrated example, the trim breaker 24 defines the refrigerator compartment perimeter 26 around the upper aperture 102*a* and defines the freezer compartment perimeter 28 around the lower aperture 102*b*.

Figure 5:
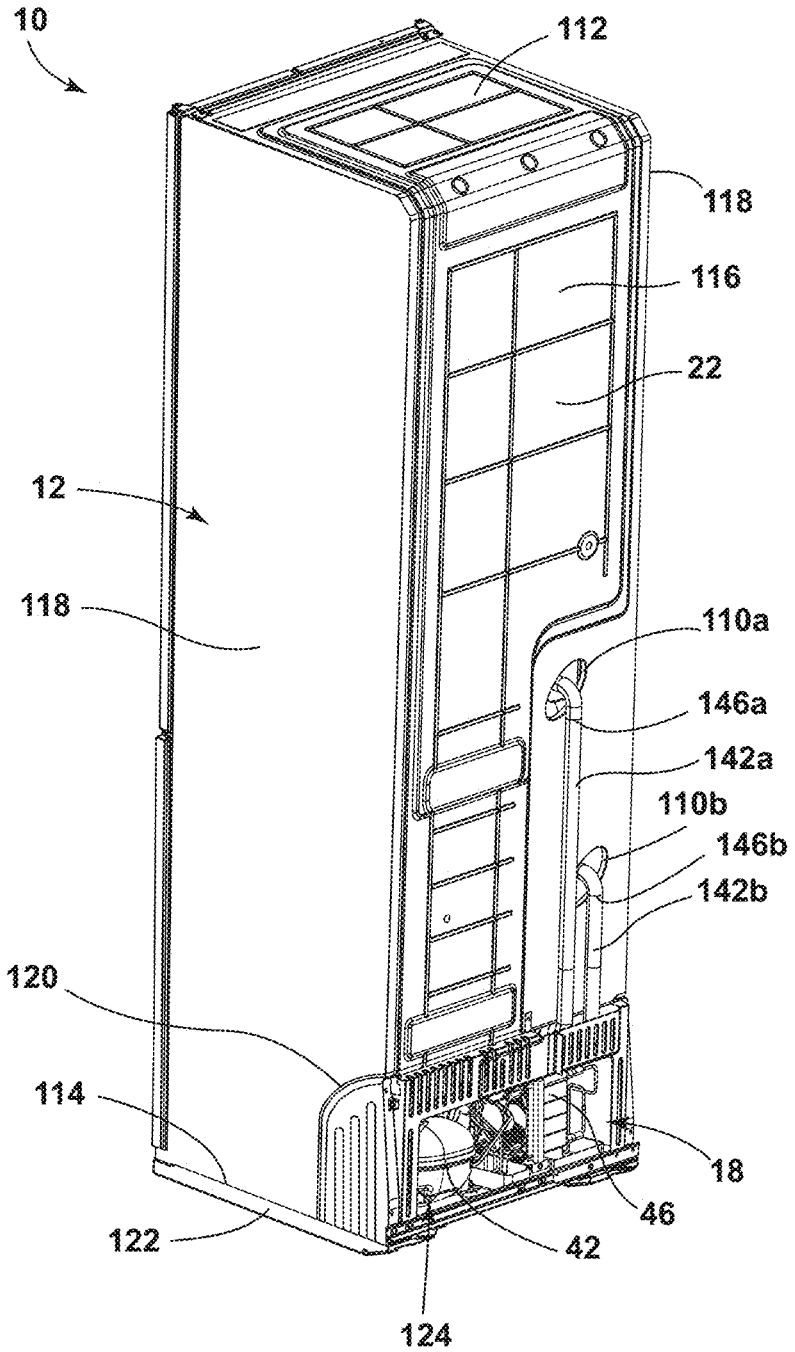
FIG. 5 is a side perspective view of a refrigeration appliance with a machine compartment housing a portion of a refrigerant system, according to the present disclosure.
Figure 6:
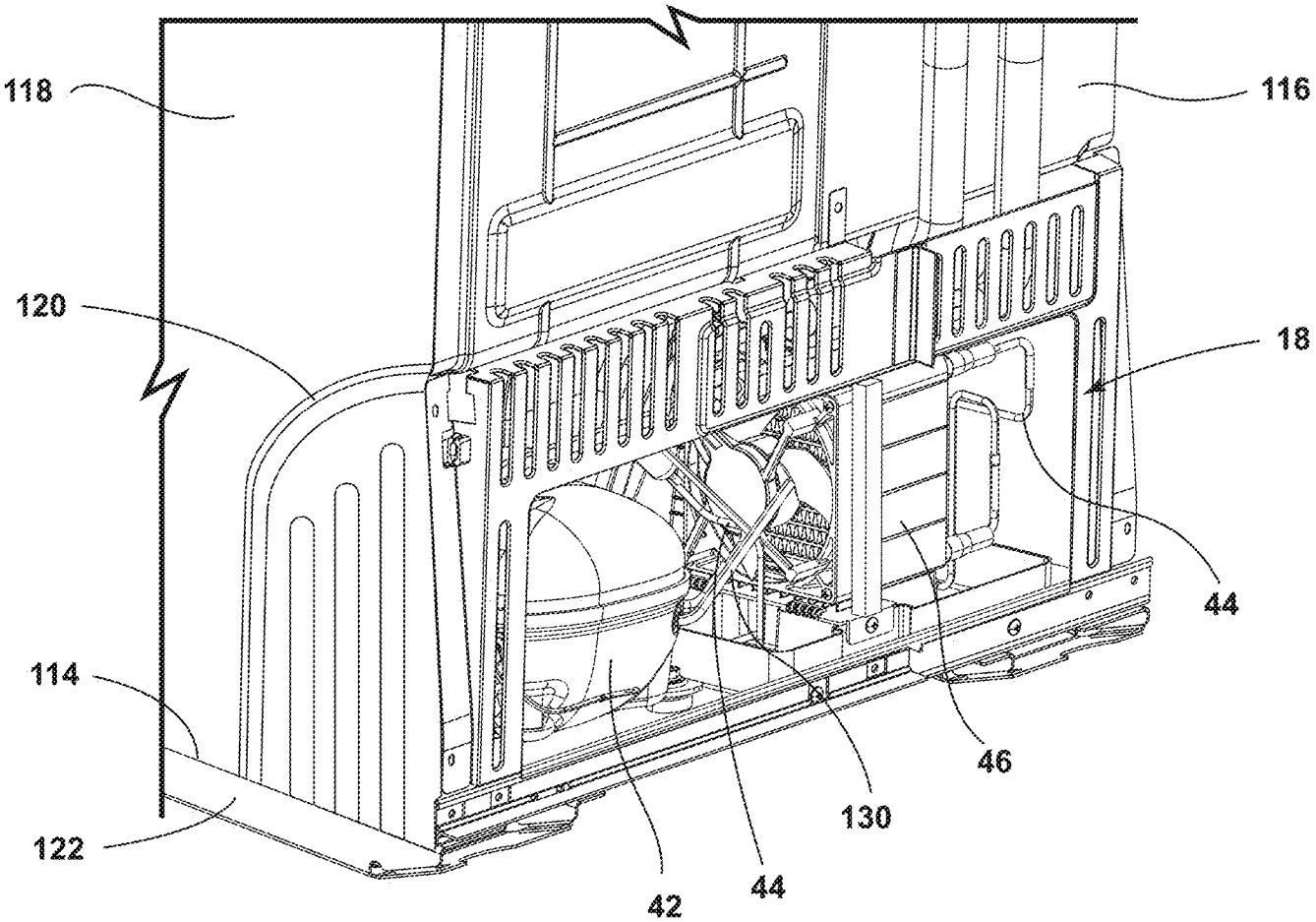
FIG. 6 is an enlarged side perspective view of the machine compartment of FIG. 5, according to the present disclosure.

Referring to FIGS. 5 and 6, passthroughs 110*a*, 110*b* are defined by the wrapper 22 and the liner 20 to provide a passage for electrical, fluid, and other appliance connections between the refrigerator and freezer compartments 14, 16 and outside the cabinet 12. The wrapper 22 has top surface 112, a bottom surface 114, a rear surface 116, a pair of side surfaces 118, and a curved surface 120. The bottom surface 114 of the wrapper 22 may be coupled to a base 122. The curved surface 120 of the wrapper 22 and the base 122 at least partially define the mechanical compartment 18. The liner 20 can generally have a similar shape as the wrapper 22 to be fit within the wrapper 22 and form the cabinet 12.

Various appliance components 124 can be positioned on the base 122 within the mechanical compartment 18 below the rear surface 116 and proximate to the curved surface 120 of the wrapper 22. The appliance components 124 positioned within the mechanical compartment 18 include components of the refrigerant system 40, including the compressor 42, portions of the heat loop 44, the condenser 46, and/or portions of the evaporator assembly 48. The appliance components 124 may also include a controller, electronics, or other components for operation of the appliance 10.

Figure 7:
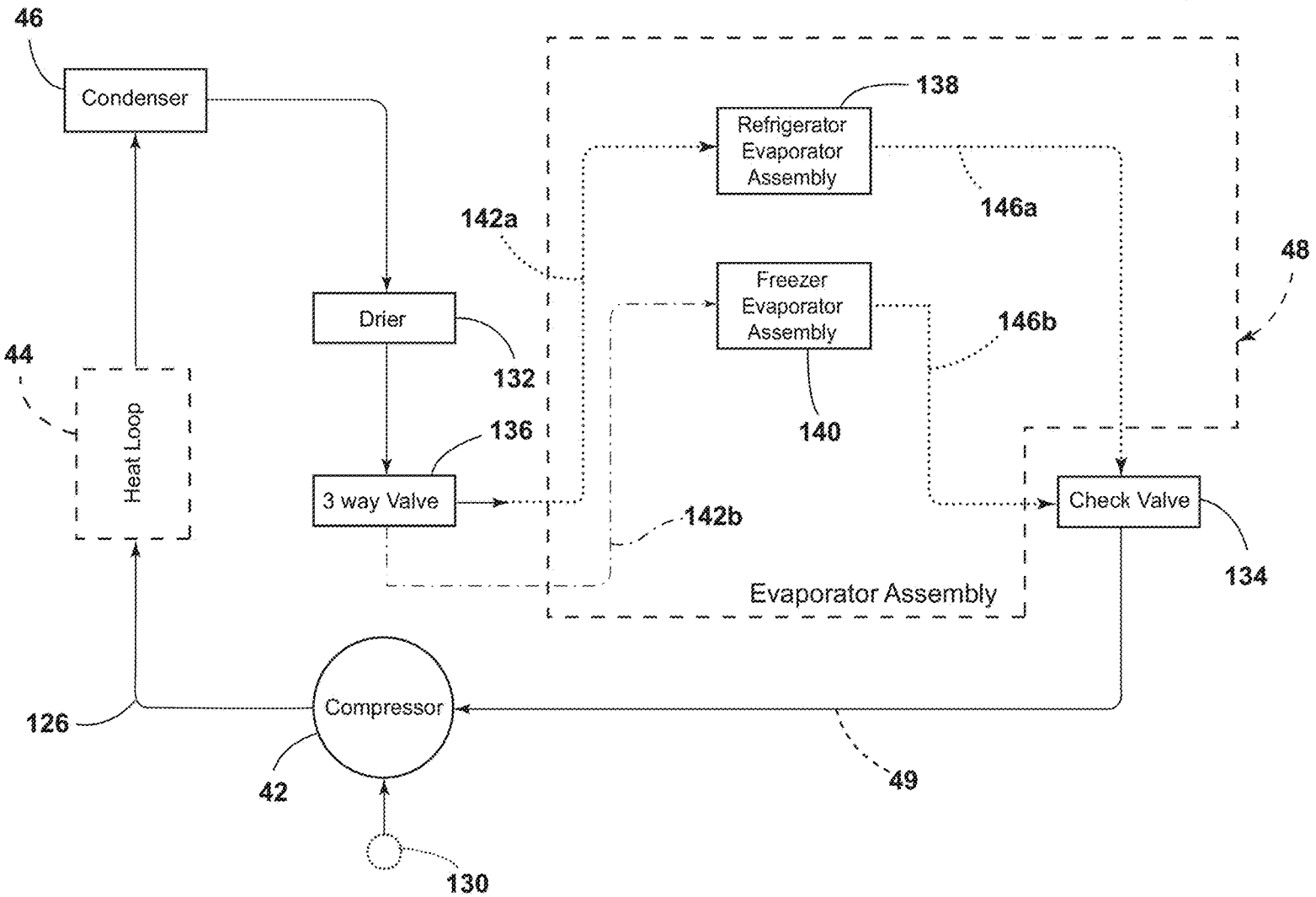
FIG. 7 is a flow diagram of a refrigerant system for a refrigeration appliance, according to the present disclosure.

As illustrated in FIG. 7, a flow diagram depicts a flow path 126 for a thermal exchange media, referred to herein as the refrigerant 49, through the refrigerant system 40. The refrigerant 49 is generally capable of undergoing repeated phase changes between a liquid and a gas. The refrigerant system 40 generally performs a refrigeration cycle that cools the refrigerator and freezer compartments 14, 16 by using the refrigerant 49 as the thermal exchange media between the compartments 14, 16 and an external environment. The flow path 126 of the refrigerant 49 generally starts by flowing from the compressor 42, through the heat loop 44, through the condenser 46, through the evaporator assembly 48, and then returns to the compressor 42.

The refrigerant 49 enters the compressor 42 as a low-pressure gas. The refrigerant 49 may also be introduced to the compressor 42 and refrigerant system 40 using a refrigerant inlet 130. The compressor 42 is configured to compress the refrigerant 49 into a higher-pressure gas. During the compression, the refrigerant 49 temperature increases. The compressor 42 is also configured to circulate the refrigerant 49 through the refrigerant system 40. The refrigerant 49 exits the compressor 42 and enters the heat loop 44 as the higher-pressure gas. The heat loop 44 is coupled to the compressor 42 and is generally routed out of the mechanical compartment 18, along the refrigerator and freezer compartment perimeters 26, 28 and through the mullion region 30, and returns to the mechanical compartment 18. The heat loop 44 is coupled to the trim breaker 24 and assists with temperature regulation about the compartments 14, 16. Specific configurations of the heat loop 44 are discussed further herein. The refrigerant 49 remains as the higher-pressure gas while flowing through the heat loop but may have a reduced temperature because of heat exchange with the trim breaker 24 and other components proximate the trim breaker 24.

The heat loop 44 extends into the machine compartment 18, and the refrigerant 49 exits the heat loop 44 and the enters the condenser 46 as a higher-pressure gas. The condenser 46 is coupled to the heat loop 44 and is configured as a heat exchanger. The condenser 46 may exchange heat with ambient air in the mechanical compartment 18. The condenser 46 condenses the refrigerant 49 to a liquid, releasing heat. The condenser 46 may be coupled to a drier 132. The drier 132 is configured to trap moisture, dirt, or other contaminants that may be present in the refrigerant system 40. The refrigerant 49 exits the drier 132 and is directed to the evaporator assembly 48. It is also contemplated that the refrigerant system 40 may not include the drier 132. In such configurations, the condenser 46 is coupled to the evaporator assembly 48.

The refrigerant 49 exits the condenser 46 or the drier 132 and enters the evaporator assembly 48. The evaporator assembly 48, discussed further herein, is configured to cool the refrigerator compartment 14 and/or the freezer compartment 16. As the refrigerant flows through the evaporator assembly 48, the refrigerant 49 experiences a pressure drop and becomes a low-pressure liquid configured to absorb heat, thereby cooling the compartments 14, 16. The refrigerant 49 exits the evaporator assembly 48, enters a check valve 134 as the low-pressure gas, and returns to the condenser 46, starting the refrigerant system 40. The check valve 134 may be coupled to the evaporator assembly 48 and the compressor 42. The check valve 134 regulates the direction of flow of the refrigerant 49 and prevents the refrigerant 49 from back-feeding from the compressor 42 to the evaporator assembly 48. It is contemplated that the refrigerant system 40 may not include the check valve 134. In such configurations, the evaporator assembly 48 is directly coupled to the compressor 42.

Still referring to FIG. 7, a three-way valve 136 may be disposed between the condenser 46 or the drier 132 and the evaporator assembly 48. The three-way valve 136 is coupled to the condenser 46 or the drier 132 and splits the flow of the refrigerant 49 between a refrigerator evaporator assembly 138 and a freezer evaporator assembly 140. The evaporator assembly 48 may include the refrigerator evaporator assembly 138, the freezer evaporator assembly 140, or both. The three-way valve 136 may be omitted when the evaporator assembly 48 includes one of the refrigerator evaporator assembly 138 or the freezer evaporator assembly 140. The evaporator assembly 48, as illustrated, includes both the refrigerator evaporator assembly 138, disposed in the refrigerator compartment 14, and the freezer evaporator assembly 140, disposed in the freezer compartment 16, which are routed in parallel along the flow path 126. The refrigerator and freezer evaporator assemblies 138, 140 are both coupled to the three-way valve 136 via capillary tubes 142*a*, 142*b* and/or an expansion valve. The capillary tubes 142*a*, 142*b* regulate the flow of the refrigerant 49 through the refrigerator and freezer evaporator assemblies 138, 140. The refrigerant 49 experiences a pressure loss through the capillary tubes 142*a*, 142*b* and becomes the low-pressure liquid. As the refrigerant 49 flows through the refrigerator and freezer evaporator assemblies 138, 140, the refrigerant 49 phase changes into the low-pressure gas, removing heat from the refrigerator compartment 14 and freezer compartment 16, respectively.

The refrigerant 49 exits the refrigerator and freezer evaporator assemblies 138, 140 and enters the check valve 134. The refrigerator and freezer evaporator assemblies 138, 140 are both coupled to the check valve 134 using suction lines 146*a*, 146*b*. The refrigerant system 40 may include other components and is not limited to the components discussed herein.

The heat loop 44 is disposed directly between the compressor 42 and the condenser 46. In this way, the refrigerant 49 is directed from the compressor 42 to the heat loop 44 and then from the heat loop 44 to the condenser 46. The heat loop 44 being coupled between the compressor 42 and the condenser 46 allows for increased performance of the heat loop 44. The heat loop 44 reduces or prevents condensation on the periphery of the cabinet 12 at the trim breaker 24 and the wrapper 22. The heat loop 44 being coupled between the compressor 42 and condenser 46 increases the temperature of the refrigerant 49 running through the heat loop 44, resulting in the decrease in condensation.

Figure 8:
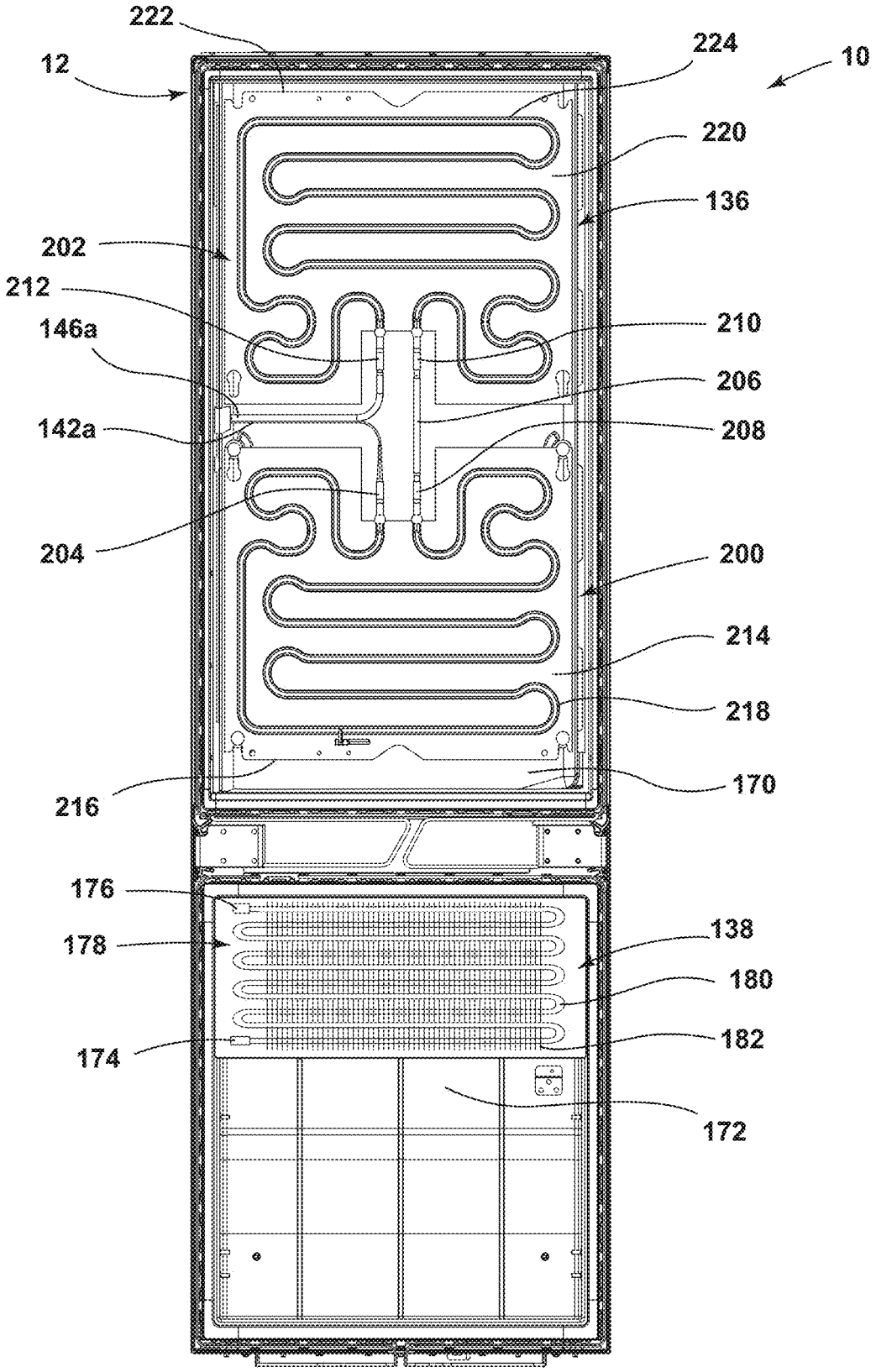
FIG. 8 is a front elevational view of a first roll bond evaporator coupled to a second roll bond evaporator in a first compartment of an appliance, an evaporator in a second compartment, and a heat loop, according to the present disclosure.
Figure 9:
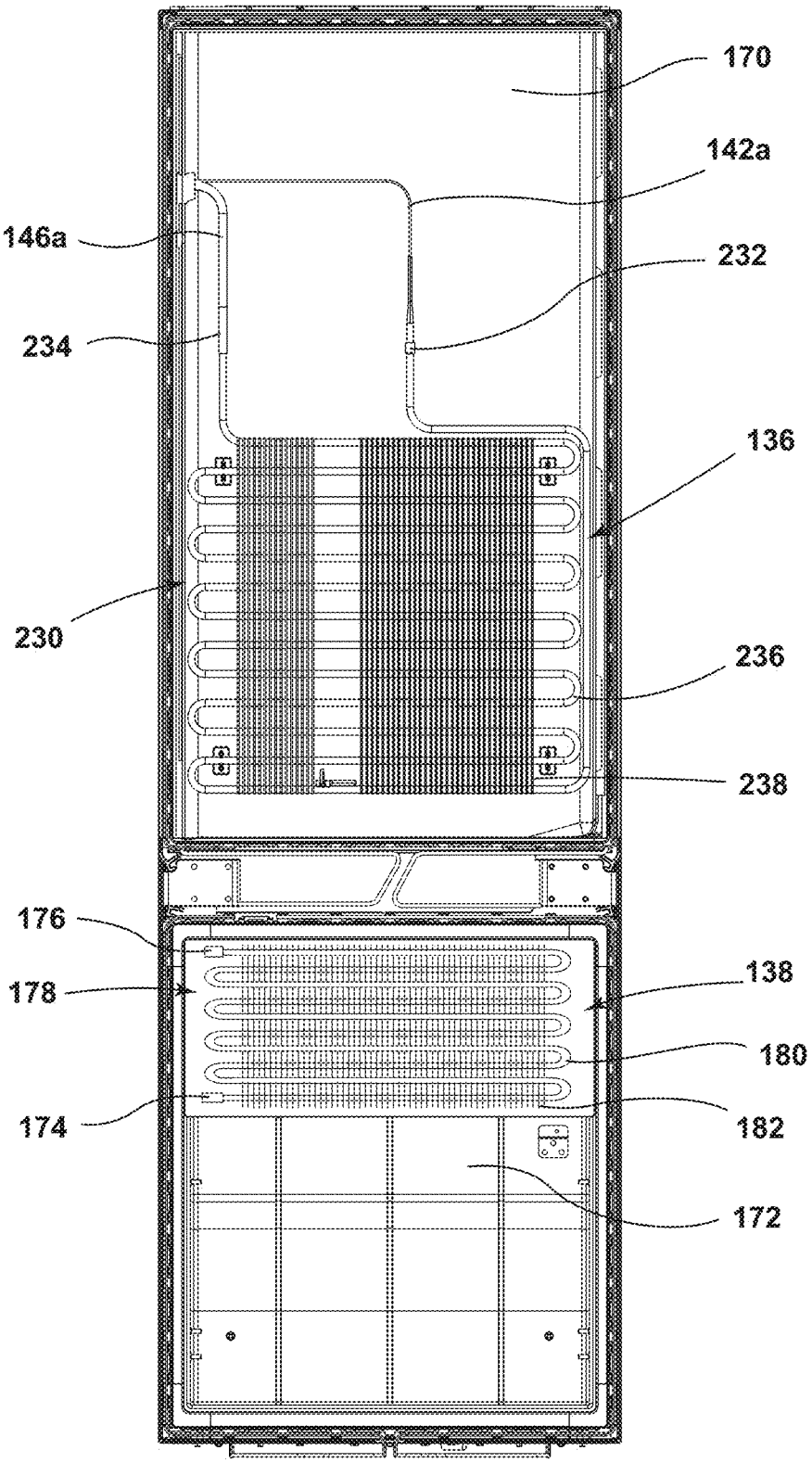
FIG. 9 is a front elevational view of a wire-on-tube evaporator in a first compartment of an appliance, an evaporator in a second compartment, and a heat loop, according to the present disclosure.

Referring again to FIG. 5, as well as FIGS. 8 and 9, the refrigerator evaporator assembly 138 is coupled to at least one interior surface 170 of the liner 20 within the refrigerator compartment 14, and the freezer evaporator assembly 140 is coupled to at least one interior surface 172 of the liner 20 within the freezer compartment 16. The capillary tube 142*a* and suction line 146*a* for the refrigerator evaporator assembly 138 are routed through the upper passthrough 110*a*. The capillary tube 142*b* and suction line 146*b* for the freezer evaporator assembly 140 are routed through the lower passthrough 110*b*. The capillary tube 142*b* is coupled to an inlet 174 of the freezer evaporator assembly 140 and the suction line 146*b* is coupled to an outlet 176 of the freezer evaporator assembly 140.

In the illustrated configuration, the freezer evaporator assembly is configured as a fin-on-tube evaporator 178. The fin-on-tube evaporator 178 has a refrigerant tube 180 and a plurality of fins 182 coupled to the refrigerant tube 180. Air flows through the fin-on-tube evaporator 178 and transfers heat through both the refrigerant tube 180 and the plurality of fins 182. While the fin-on-tube evaporator 178 is depicted, other evaporator assemblies or configurations may be used for the freezer evaporator assembly 140.

Referring still to FIG. 8, the refrigerator evaporator assembly 138 may include a first roll bond evaporator 200 coupled to a second roll bond evaporator 202. The first and second roll bond evaporators 200, 202 are coupled together in series along the flow path 126. The capillary tube 142*a* is coupled to an inlet 204 of the first roll bond evaporator 200. A refrigerant line 206 is coupled to an outlet 208 of the first roll bond evaporator 200 and to an inlet 210 of the second bond evaporator 202. The suction line 146*a* is coupled to an outlet 212 of the second roll bond evaporator 202. The first roll bond evaporator 200 has a first panel 214 and a second panel 216 coupled together to define a refrigerant channel 218 between the inlet 204 and the outlet 208. Similarly, the second roll bond evaporator 202 has a first panel 220 and a second panel 222 coupled together to define a refrigerant channel 224 between the inlet 210 and the outlet 212. Air in the refrigerator compartment 14 flows along the first and second roll bond evaporators 200, 202 and is cooled by transferring heat to the refrigerant 49.

Referring to FIG. 9, the refrigerator evaporator assembly 138 may include a wire-on-tube evaporator 230. The capillary tube 142*a* is coupled to an inlet 232 of the wire-on-tube evaporator 230. The suction line 146*a* is coupled to an outlet 234 of the wire-on-tube evaporator 230. The wire-on-tube evaporator 230 has a refrigerant tube 236 and a plurality of wires 238 coupled to the refrigerant tube 236. The plurality of wires 238 may be run perpendicular to the refrigerant tube 236. Air in the refrigerator compartment 14 flows over the wire-on-tube evaporator 230 and is cooled by the plurality of wires 238 and transfers heat to the refrigerant 49. The plurality of wires 238 transfer the heat from the air to the refrigerant tube 236.

The evaporator assembly 48 including either the first and second roll bond evaporators 200, 202 or the wire-on-tube evaporator 230 helps improve the balancing of the refrigerant system 40 between the refrigerator and freezer evaporator assemblies 138, 140. The inclusion of either the first and second roll bond evaporators 200, 202 or the wire-on-tube evaporator 230 also reduces or prevent a buildup of condensation on the suction lines 146*a*, 146*b*. The first and second roll bond evaporators 200, 202 and/or the wire-on-tube evaporator 230 allows for a more complete evaporation of the refrigerant 49 and helps prevent liquid refrigerant from entering the suction line 146*a* and the compressor 42. The more complete evaporation of the refrigerant 49 may also allow for the removal of an accumulator from the refrigerant system 40. The removal of the accumulator may help decreases the complexity of the system, the time of manufacturing, and ease maintenance of the system. Moreover, the roll bond evaporators 200, 202 and/or the wire-on-tube evaporator 230 may be advantageous for increasing surface area of the refrigerator evaporator assembly 138 to maximize efficiency in the heat exchange process.

Referring to FIGS. 10-13, the configuration of the heat loop 44 may also assist in improving thermal regulation of the appliance 10. The heat loop 44 is generally routed around a perimeter of the cabinet 12 and through the mullion region 30. The heat loop 44 is routed from the mechanical compartment 18, along the refrigerator and freezer compartment perimeters 26, 28, through the mullion region 30, and returns to the mechanical compartment 18 to couple to the condenser 46. The heat loop 44 is coupled to the trim breaker 24 along the compartment perimeters 26, 28 and in the mullion region 30. The heat loop 44 includes the first send segment 50 routed from the mechanical compartment 18 along the first portion 52 of the freezer compartment perimeter 28, the second send segment 54 routed through the mullion region 30, and the third send segment 56 routed along the first portion 58 of the refrigerator compartment perimeter 26. The heat loop 44 also includes the first return segment 60 routed along the second portion 62 of the refrigerator compartment perimeter 26, the second return segment 64 routed through the mullion region 30, and the third return segment 66 routed along the second portion 68 of the freezer compartment perimeter 28 to the mechanical compartment 18.

The first send segment 50 may be routed from the mechanical compartment 18 and couple to the trim breaker 24 proximate a center line 250 of the cabinet 12. Additionally, the third return segment 66 may decouple from the trim breaker 24 proximate the center line 250 of the cabinet 12 and be routed to the mechanical compartment 18. The first portion 52 of the freezer compartment perimeter 28 may start at the center line 250 on a first, lower edge 252 of the freezer compartment perimeter 28, extending along the first edge 252, along a second, side edge 254 of the freezer compartment perimeter 28, and stopping proximate the mullion region 30. The second portion 68 of the freezer compartment 16 may start at the center line 250 on the first edge 252, extending along the first edge 252, extending along a third, side edge 256 of the freezer compartment 16, and stopping proximate the mullion region 30.

The first portion 58 of the refrigerator compartment perimeter 26 may start proximate the mullion region 30 extending along a first, side edge 258 of the refrigerator compartment perimeter 26, extending along a second, upper edge 260 of the refrigerator compartment 14, and stopping at the center line 250 on the second edge 260. The second portion 62 of the refrigerator compartment 14 transitions from the first portion 58 proximate the center line 250, extending along the second edge 260 of the refrigerator compartment 14, extending along a third, side edge 262 of the refrigerator compartment 14, and stopping at the mullion region 30.

Figure 10:
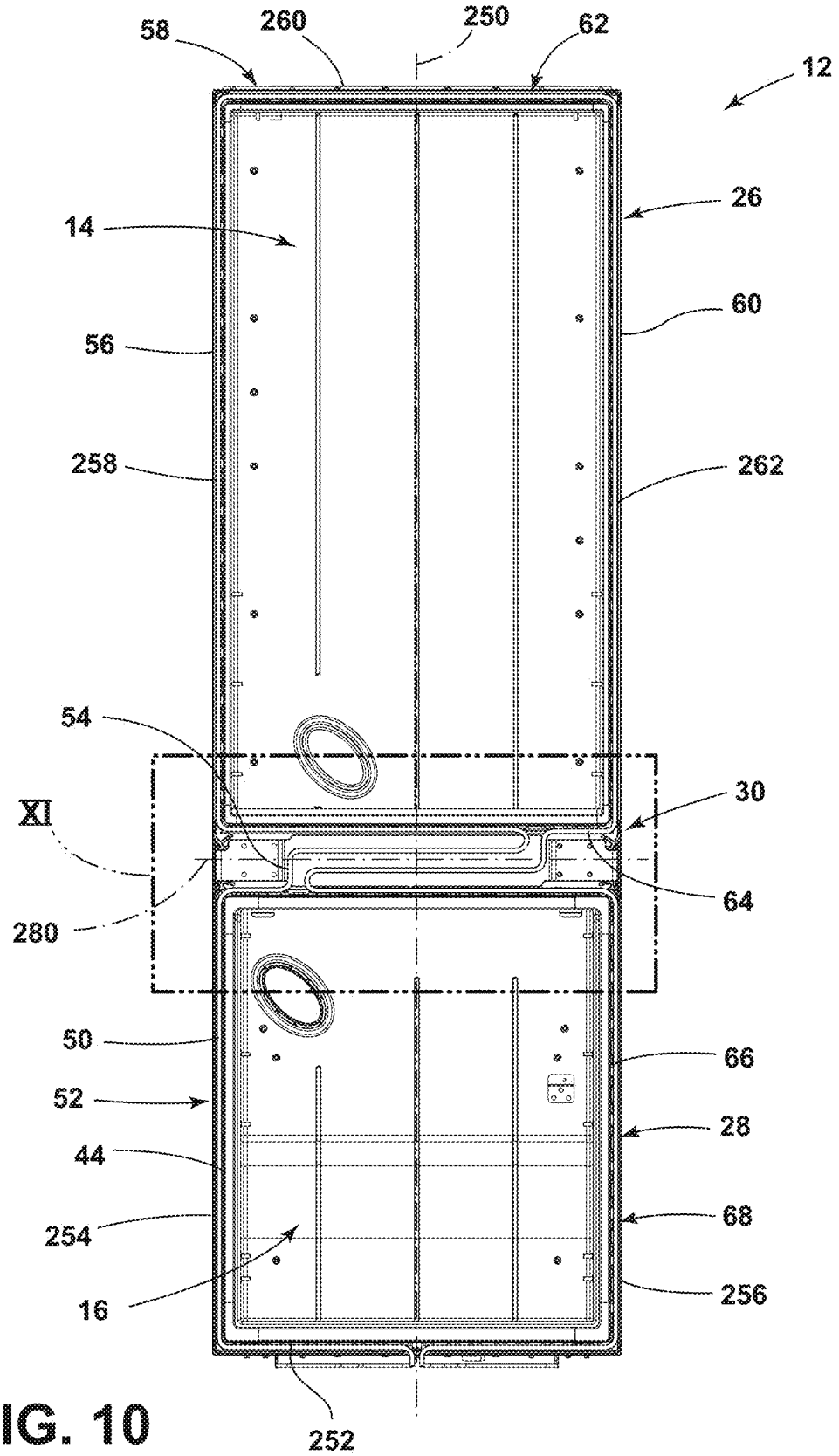
FIG. 10 is a front elevational view of a heat loop routed along an appliance perimeter and through a mullion region, according to the present disclosure.
Figure 11:
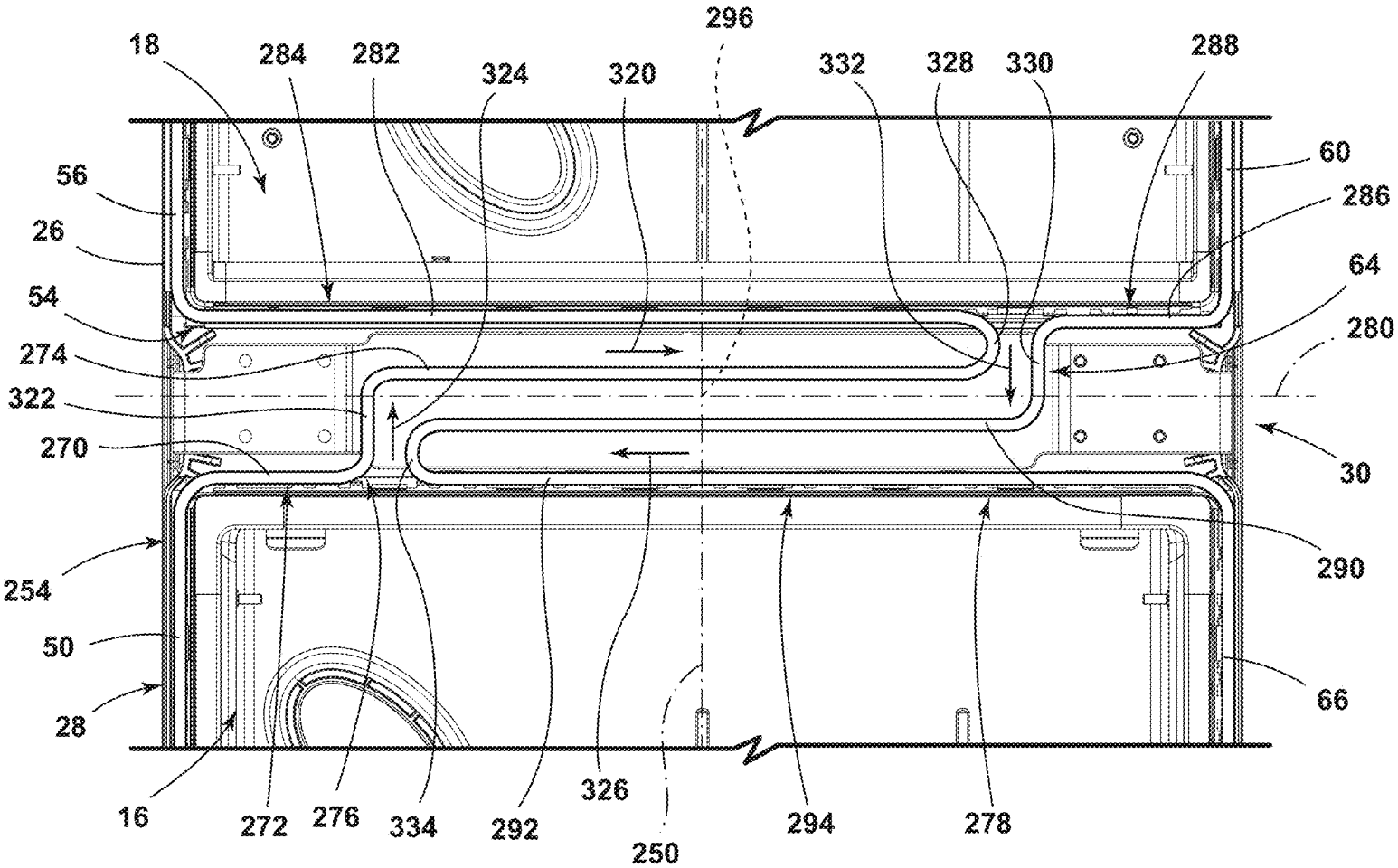
FIG. 11 is a partial enlarged front elevational view of the heat loop routed through the mullion region of FIG. 10, taken at area XI.

Referring still to FIGS. 10 and 11, the heat loop 44 may be routed through the mullion region 30 in different configurations to limit temperature variation within the mullion region 30 and a prevent condensation buildup on in the mullion region 30. A first configuration of the heat loop 44 routed through the mullion region 30 is illustrated. The second send segment 54, which is also referred to herein as the send portion 54, may have a generally "Z" shape or a serpentine shape, extending toward the refrigerator compartment 14, through the mullion region 30, and again towards the refrigerator compartment 14.

The second send segment 54 routed through the mullion region 30 includes a first mullion segment 270 which is routed along a first mullion portion 272 of the freezer compartment perimeter 28. The first mullion portion 272 extends between the side edge 254 and where the send segment 54 extends towards the refrigerator compartment 14. A second mullion segment 274 extends from a first lateral side 276, also referred to as a first end 276, of the mullion region 30 to a second lateral side 278, also referred to as a second end 278, of the mullion region 30. The two sides or ends 276, 278 are on opposing sides of the center line 250. The second mullion segment 274 extends proximate a midline 280 between the freezer compartment 16 and the refrigerator compartment 14. A third mullion segment 282 is routed along a first mullion portion 284 of the refrigerator compartment perimeter 26. The third mullion segment 282 is generally parallel to the first mullion segment 270 and the second mullion segment 274. The third mullion segment 282 is generally longer than the first mullion segment 270.

The second return segment 64, also referred to as the return portion 64, of the heat loop 44 may have a generally "Z" shape or a serpentine shape, extending toward the freezer compartment 16, through the mullion region 30, and again towards the freezer compartment 16. The second return segment 64 includes a first mullion segment 286 routed along a second mullion portion 288 of the refrigerator compartment perimeter 26. A second mullion segment 290 extends from the second lateral side 278 of the mullion region 30 to the first lateral side 276 of the mullion region 30 proximate the midline 280. A third mullion segment 292 is routed along a second mullion portion 294 of the freezer compartment perimeter 28. The third mullion segment 292 is generally parallel to the first mullion segment 286 and the second mullion segment 290. The third mullion segment 292 is generally longer than the first mullion segment 286.

The send portion 54 routed proximate the midline 280 may extend proximate and parallel to the return portion 64 routed proximate to the midline 280. Accordingly, the second mullion segment 274 of the second send segment 54 may extend proximate and parallel to the second mullion segment 290 of the second return segment 64. The second mullion segment 274 of the second send segment 54 and the second mullion segment 290 of the second return segment 64 may extend equidistance from the midline 280 and/or equidistance from the freezer compartment perimeter 28 and the refrigerator compartment perimeter 26, respectively. The send portion 54 and the return portion 64 may generally be rotationally symmetrical around a center point 296 defined by the intersection of the center line 250 and the midline 280. The send portion 54 and/or the return portion 64 may cross the center line 250.

Stated a different way, the heat loop 44 routed through the mullion region 30 includes the send portion 54 and the return portion 64. The send portion 54 of the heat loop 44 is routed proximate to the first mullion portion 272 of the freezer compartment perimeter 28, proximate to the midline 280 between the freezer compartment 16 and the refrigerator compartment 14 and from the first end 276 of the mullion region 30 to the second end 278 of the mullion region 30, and proximate to the first mullion portion 284 of the refrigerator compartment perimeter 26. The return portion 64 of the heat loop 44 is routed proximate to the second mullion portion 288 of the refrigerator compartment perimeter 26, proximate to the midline 280 and from the second end 278 to the first end 276, and proximate to the second mullion portion 294 of the freezer compartment perimeter 28.

Referring still to FIGS. 10 and 11, the first mullion segment 270 of the second send segment 54 is routed in a first direction 320, as illustrated by arrow 320. The second mullion segment 274 is routed in the first direction 320 and is coupled to the first mullion segment 270 with a connector segment 322, which is routed from the first direction 320 to a second direction 324, as illustrated by arrow 324, and again in the first direction 320. The second direction 324 may be perpendicular to the first direction 320. The third mullion segment 282 is routed in a third direction 326, as illustrated by arrow 326, and is coupled to the second mullion segment 274 with a connecter segment 328, which is routed from the first direction 320 to the third direction 326. The first direction 320 and the third direction 326 may be opposing, horizontal directions. The second direction 322 may be perpendicular to the first and/or third directions 320, 326.

The first mullion segment 286 of the second return segment 64 is routed in the third direction 326. The second mullion segment 290 is routed in the third direction 326 and is coupled to the second mullion segment 290 with a connector segment 330, which is routed from the third direction 326 to a fourth direction 332, illustrated by arrow 332, and to the first direction 320. The fourth direction 332 may be perpendicular to the third direction 326. The second direction 324 and the fourth direction 332 may be opposing directions. The third mullion segment 292 is routed in the first direction 320 and is coupled to the second mullion segment 290 with a connector segment 334, which is routed from the third direction 326 to the first direction 320.

Referring again to FIGS. 12 and 13, a second configuration of the heat loop 44 routed through the mullion region is illustrated. The second send segment 54, also referred to as the send portion 54, routed through the mullion region 30 includes a first mullion segment 340 routed along a first mullion portion 342 of the freezer compartment perimeter 28, a second mullion segment 344 extending at an obtuse angle A1 from a lower or freezer side 346 of the mullion region 30 to an upper or refrigerator side 348 of the mullion region 30, and a third mullion segment 350 routed along a first mullion portion 352 of the refrigerator compartment perimeter 26.

The second return segment 64, also referred to as the return portion 64, of the heat loop 44 includes a first mullion segment 354 routed along a second mullion portion 356 of the refrigerator compartment perimeter 26, a second mullion segment 358 extending at an obtuse angle A2 from the refrigerator side 348 of the mullion region 30 to the freezer side 346 of the mullion region 30, and a third mullion segment 360 routed along a second mullion portion 362 of the freezer compartment perimeter 28. The second mullion segment 344 of the second send segment 54 may extend proximate and parallel to the second mullion segment 358 of the second return segment 64. The send portion 54 and the return portion 64 may generally be rotationally symmetrical around the center point 296. The send portion 54 and/or the return portion 64 may cross the center line 250.

Stated a different way, the heat loop 44 routed through the mullion region 30 includes the send portion 54 and the return portion 64. The send portion 54 is routed proximate to the first mullion portion 342 of the freezer compartment 16, from the lower side 346 of the mullion region 30 to the upper side 348 of the mullion region 30 at the obtuse angle A1 relative to the lower side 346 of the mullion region 30, and proximate to the first mullion portion 352 of the refrigerator compartment 14. The return portion 64 is routed proximate to the second mullion portion 356 of the refrigerator compartment 14, from the upper side 348 to the lower side 346 at the obtuse angle A2 relative to the upper side 348 of the mullion region 30, and proximate to the second mullion portion 362 of the freezer compartment 16. The obtuse angle A1 and obtuse angle A2 may be the same angle.

The obtuse angle A1 is defined as the angle between the first mullion segment 340 of the second send segment 54 and the second mullion segment 344 of the second send segment 54. The obtuse angle A2 is defined as the angle between the first mullion segment 354 of the second return segment 64 and the second mullion segment 358 of the second return segment 64. The obtuse angles A1 may be defined as the angle between the midline 280 and the second mullion segment 344 of the second send segment 54. The obtuse angles A2 may be defined as the angle between the midline 280 and the second mullion segment 358 of the second return segment 64. The obtuse angles A1 and A2 are equal when the second mullion segment 344 of the second send segment 54 extends parallel to the second mullion segment 358 of the second return segment 64.

Figure 12:
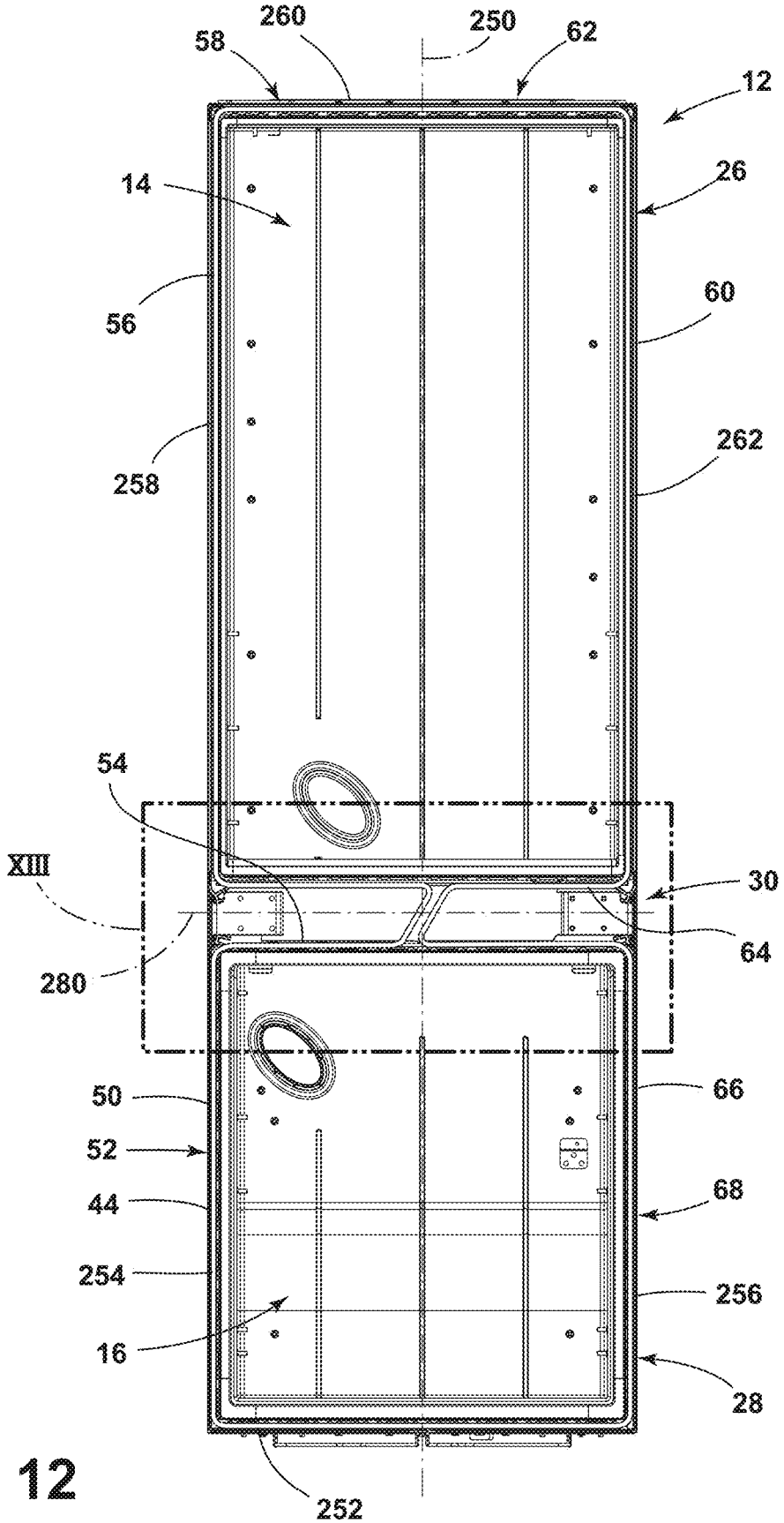
FIG. 12 is a front elevational view of a heat loop routed along an appliance perimeter and through a mullion region, according to the present disclosure.
Figure 13:
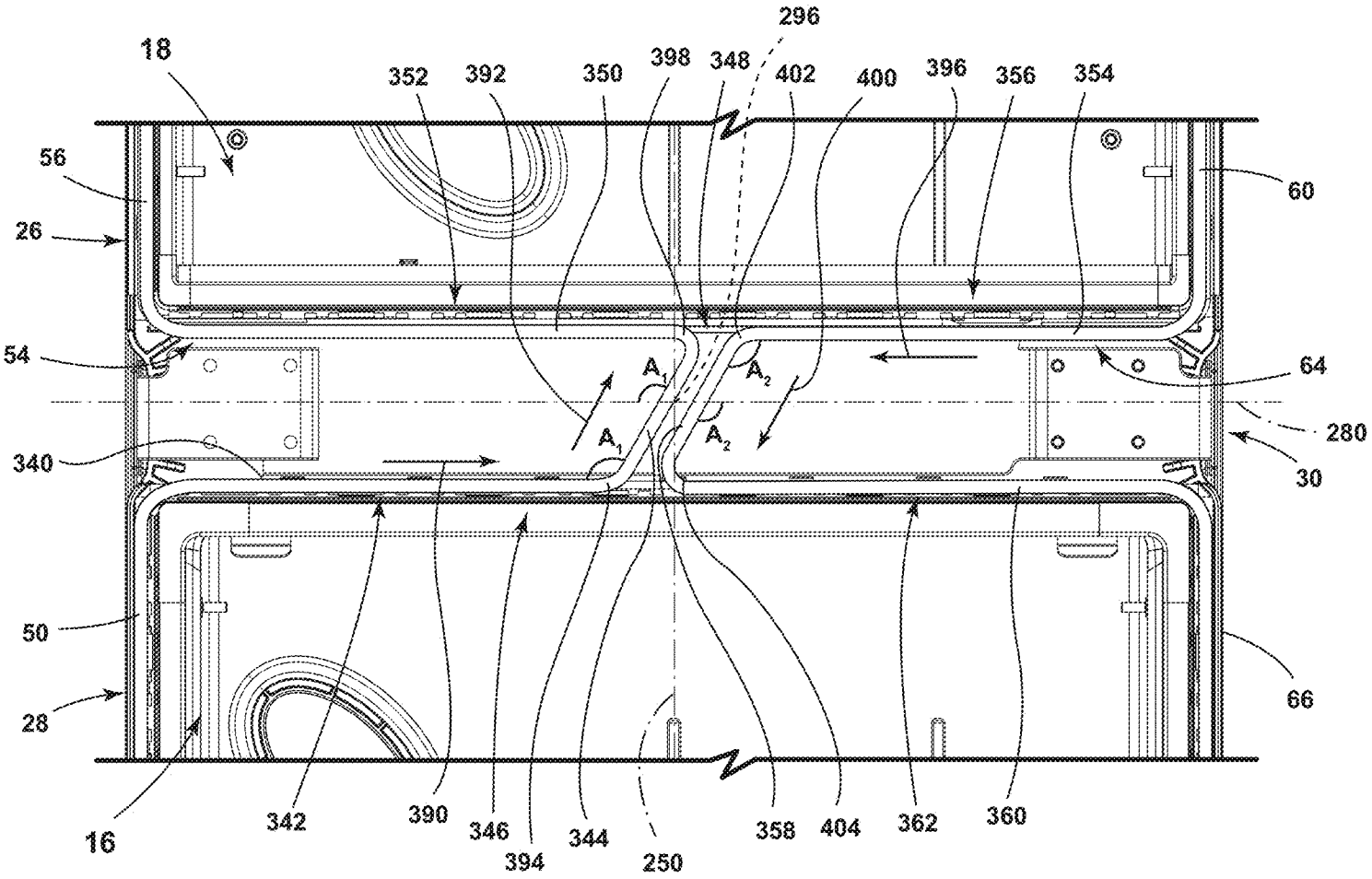
FIG. 13 is a partial enlarged front elevational view of the heat loop routed through the mullion region of FIG. 12, taken at area XIII.

Referring still to FIGS. 12 and 13, the first mullion segment 340 of the second send segment 54 is routed in a first direction 390, as illustrated by arrow 390. The second mullion segment 344 is routed in a second direction 392, as illustrated by arrow 392, and is coupled to the first mullion segment 340 with a connector segment 394, which is routed in the first direction 390 to the second direction 392. The second direction 392 is at the obtuse angle A1 in the first direction 390. The third mullion segment 350 is routed in a third direction 396, as illustrated by arrow 396 and is coupled to the second mullion segment 344 by a connector segment 398, which is routed in the second direction 392 to the third direction 396. The first direction 390 and the third direction 396 may be opposing directions.

The first mullion segment 354 of the second return segment 64 is routed in the third direction 396. The second mullion segment 358 is routed in a fourth direction 400, as illustrated by arrow 400, and is coupled to the first mullion segment 354 by a connector segment 402, which is routed in the third direction 396 to the fourth direction 400. The fourth direction 400 is at the obtuse angle A2 to the third direction 396. The fourth direction 400 and the second direction 392 may be opposing directions. The third mullion segment 360 is routed in the first direction 390 and is coupled to the second mullion segment 358 by a connector segment 404 routed in the fourth direction 400 to the first direction 390.

The first and second configurations of the heat loop 44 routing in the mullion region 30 reduces or prevents condensation buildup on the periphery of the cabinet 12 at the trim breaker 24 and the wrapper 22. Both configurations can reduce or minimize temperature variation or low temperature areas in the mullion region 30.

With reference to FIGS. 1-13, the refrigerant system 40 configuration, the heat loop 44 configurations, and the evaporator assembly 48 configurations may be used independently or in any combinations with each other. For example, the refrigerant system 40 with the heat loop 44 disposed between the compressor 42 and the condenser 46 may be used with the first configuration of the heat loop 44. The heat loop 44 configurations may also be used independently of the refrigerant system 40 discussed and used with a refrigerant system having the heat loop 44 disposed between a condenser and an evaporator assembly. The evaporator assemblies 48 may be used with the refrigerant system 40 and/or the heat loop 44 configurations or may be used independently of the other systems.

Use of the present device may provide a variety of advantages. For example, the refrigerant system 40 may have an improved system balance between the refrigerator evaporator assembly 138 and the freezer evaporator assembly 140 when the refrigerator evaporator assembly 138 is either the first roll bond evaporator 200 coupled to the second roll bond evaporator 202 or the wire-on-tube evaporator 230. Both configurations of the refrigerator evaporator assembly 138 increase heat transfer between the refrigerator compartment 14 and the refrigerant system 40. The configurations of the refrigerator evaporator assembly 138 increase a cooling load to reduce or prevent liquid refrigerant from entering the compressor 42, which reduces external condensation on the suction lines 146*a*, 146*b*. Additionally, disposing the heat loop 44 between the compressor 42 and the condenser 46 may better regulate temperature along the trim breaker 24 and through the mullion region 30, which can reduce or prevent external condensation. Moreover, the configuration of the heat loop 44 between the compressor 42 and the condenser 46 may also optimize the layout of the refrigerant system 40 and/or the appliance 10. Further, the configurations of the heat loop 44 in the mullion region 30 may help create a consistent or more consistent temperature across the mullion region 30 and reduce or eliminate low temperature spots. The more consistent temperature in the mullion region 30 helps reduce external condensation in the mullion region 30. Also, each of the refrigerant system 40 configuration, the heat loop 44 configurations, and the evaporator assembly 48 configurations may be utilized independently or in combination to increase energy efficiency of the vacuum insulated appliance 10 and reduce refrigerant cycle time within the refrigerant system 40. Additional benefits or advantages may be realized and/or achieved.

The device disclosed herein is further summarized in the following paragraphs and is further characterized by combinations of any and all of the various aspects described herein.

According to an aspect of the present disclosure, a vacuum insulated refrigerator includes a cabinet defining a refrigerator compartment and a freezer compartment where the cabinet at least partially defines a mechanical compartment. The cabinet includes a liner, a wrapper, and a trim breaker. The trim breaker is coupled to the liner and the wrapper. The trim breaker defines a refrigerator compartment perimeter, a freezer compartment perimeter, and a mullion region between the refrigerator compartment and the freezer compartment. The refrigerant system includes a compressor disposed in the mechanical compartment. A heat loop is coupled to the compressor where the heat loop includes a first send segment routed from the mechanical compartment and along a first portion of the freezer compartment perimeter, a second send segment routed through the mullion region, and a third send segment routed along a first portion of the refrigerator compartment perimeter adjacent the mullion region. A first return segment is routed along a second portion of the refrigerator compartment perimeter, a second return segment is routed through the mullion region, and a third return segment is routed along a second portion of the freezer compartment perimeter and to the mechanical compartment. A condenser is disposed in the mechanical compartment and is coupled to the heat loop, where a refrigerant is directed from the compressor, through the heat loop, and then to the condenser, and an evaporator assembly is coupled to the condenser and the compressor.

According to another aspect, a second send segment of a heat loop includes a first mullion segment routed along a first mullion portion of a freezer compartment perimeter. A second mullion segment extends from a first lateral side of a mullion region to a second lateral side of the mullion proximate a midline between a freezer compartment and a refrigerator compartment. A third mullion segment is routed along a first mullion portion of a refrigerator compartment perimeter. A second return segment of the heat loop includes a first mullion segment routed along a second mullion portion of the refrigerator compartment perimeter. A second mullion segment extends from the second lateral side of the mullion region to the first lateral side of the mullion region proximate the midline. A third mullion segment is routed along a second mullion portion of the freezer compartment perimeter. The second mullion segment of the second send segment extends proximate and parallel to the second mullion segment of the second return segment.

According to yet another aspect, a second send segment of the heat loop includes a first mullion segment routed along a first mullion portion of a freezer compartment perimeter. A second mullion segment extends at an obtuse angle from a freezer side of a mullion region to a refrigerator side of the mullion region. A third mullion segment is routed along a first mullion portion of the refrigerator compartment perimeter. A second return portion of the heat loop includes a first mullion segment routed along a second mullion portion of a refrigerator compartment perimeter. A second mullion segment extends at an obtuse angle from the refrigerator side of the mullion region to the freezer side of the mullion region. A third mullion segment is routed along a second mullion portion of the freezer compartment perimeter. The second mullion segment of the second send segment extends proximate and parallel to the second mullion segment of the second return segment.

According to another aspect, a refrigerant system includes a drier coupled to a condenser and an evaporator assembly.

According to yet another aspect, an evaporator assembly includes a refrigerator evaporator assembly disposed in a refrigerator compartment and a freezer evaporator assembly disposed in a freezer compartment where the refrigerator evaporator assembly and the freezer assembly are arranged in parallel along a refrigerant flow path.

According to another aspect, a refrigerator evaporation assembly includes a first roll bond evaporator coupled to a second roll bond evaporator. The first roll bond evaporator and the second roll bond evaporator are arranged in series along a refrigerant flow path.

According to yet another aspect, a refrigerator evaporation assembly includes a wire-on-tube evaporator, and a freezer evaporator assembly includes a fin-on-tube evaporator.

According to another aspect of the present disclosure, a vacuum insulated refrigerator includes a cabinet defining an upper compartment, a lower compartment, and a mullion region between the upper compartment and the lower compartment. The cabinet at least partially defines a machine compartment. A trim breaker is coupled to a periphery of the cabinet and the mullion region. A compressor is disposed in the machine compartment. A heat loop is fluidly coupled to the compressor where the heat loop is coupled to the trim breaker and is routed along the periphery of the cabinet and through the mullion region. A condenser is fluidly coupled to the heat loop. An evaporator assembly is fluidly coupled to the condenser and to the compressor. The evaporator assembly includes at least one first evaporator disposed in the upper compartment and a second evaporator disposed in the lower compartment. A refrigerant is configured to flow from the compressor to the heat loop, from the heat loop to the condenser, and from the condenser to the evaporator assembly.

According to another aspect, at least one first evaporator includes a first roll bond evaporator coupled to a second roll bond evaporator.

According to yet another aspect, an upper compartment is a refrigerator compartment, where at least one first evaporator is a wire-on-tube evaporator.

According to another aspect, a heat loop is routed through a mullion region which includes a send portion and a return portion. The send portion is routed proximate to a first mullion portion of a lower compartment, proximate to a midline between an upper compartment and the lower compartment and from a first end of the mullion region to a second end of the mullion region, and proximate to a first mullion portion of the upper compartment. The return portion is routed proximate to a second mullion portion of the upper compartment, proximate to the midline and from the second end to the first end, and proximate to a second mullion portion of the lower compartment. The send portion routed proximate the midline extends proximate and parallel to the return portion routed proximate to the midline.

According to yet another aspect, a heat loop is routed through a mullion region including a send portion and a return portion. The send portion is routed proximate to a first mullion portion of a lower compartment, from a lower side of the mullion region to an upper side of the mullion region at a first obtuse angle relative to the lower side of the mullion region, and proximate to a first mullion portion of an upper compartment. The return portion is routed proximate to a second mullion portion of the upper compartment, from the upper side to the lower side at a second obtuse angle relative to the upper side of the mullion region and proximate to a second mullion portion of the lower compartment. The send portion extending at the first obtuse angle extends proximate to the return portion extending at the second obtuse angle.

According to another aspect, a first obtuse angle is equal to a second obtuse angle.

According to another aspect of the present disclosure, a refrigeration appliance includes a cabinet including a wrapper and a liner where the wrapper at least partially defines a machine compartment. A trim breaker is coupled to an edge of the wrapper and an edge of the liner. The trim breaker defines a mullion region. A refrigerant system includes a compressor disposed in the machine compartment. A heat loop is coupled to the compressor. The heat loop is coupled to the trim breaker. The heat loop includes a send portion and a return portion routed through the mullion region, where the send portion and the return portion each cross a center line defined by the cabinet. A condenser is disposed in the machine compartment and is coupled to the heat loop. An evaporator assembly is coupled to the cabinet.

According to another aspect, a liner defines a refrigeration compartment and a freezer compartment. An evaporator assembly includes a wire-on-tube evaporator coupled to the liner and in the refrigeration compartment.

According to yet another aspect, a liner defines a refrigeration compartment and a freezer compartment. An evaporator assembly includes a first roll bond evaporator coupled to a second roll bond evaporator. The first roll bond evaporator and the second roll bond evaporator are arranged in series along a flow path of a refrigerant and are coupled to the liner in the refrigeration compartment.

According to another aspect, a heat loop is disposed between a compressor and a condenser. A refrigerant system is configured to direct a refrigerant along a flow path from the compressor to the heat loop, from the heat loop to the condenser, and through an evaporator assembly to the compressor.

According to yet another aspect, a cabinet defines a first compartment, a second compartment, and a mullion region between the first compartment and the second compartment. A heat loop is routed along a perimeter of the first compartment, a perimeter of the second compartment, through the mullion region between the first compartment and the second compartment.

According to another aspect, a send portion is routed proximate to a first mullion portion of a first compartment, proximate to a midline between a second compartment and the first compartment and from a first end of a mullion region to a second end of the mullion region, and proximate to a first mullion portion of the second compartment. A return portion is routed proximate to a second mullion portion of the second compartment, proximate to the midline and from the second end to the first end, and proximate to a second mullion portion of the first compartment. The send portion is routed proximate the midline extends proximate and parallel to the return portion routed proximate to the midline.

According to yet another aspect, a send portion is routed proximate to a first mullion portion of a first compartment, from a lower side of the mullion region to an upper side of a mullion region at a first obtuse angle relative to the lower side of the mullion region, and proximate to a first mullion portion of a second compartment. A return portion is routed proximate to a second mullion portion of the second compartment, from the upper side to the lower side at a second obtuse angle relative to the upper side of the mullion region and proximate to a second mullion portion of the first compartment. The send portion extending at the first obtuse angle extends parallel and proximate to the return portion extending at the second obtuse angle.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A vacuum insulated refrigerator, comprising:

a cabinet defining a refrigerator compartment and a freezer compartment, wherein the cabinet at least partially defines a mechanical compartment, wherein the cabinet includes:

a liner;

a wrapper; and a trim breaker coupled to the liner and the wrapper, wherein the trim breaker defines a refrigerator compartment perimeter, a freezer compartment perimeter, and a mullion region between the refrigerator compartment and the freezer compartment; and a refrigerant system, wherein the refrigerant system includes:

a compressor disposed in the mechanical compartment;

a heat loop coupled to the compressor, wherein the heat loop includes a first send segment routed from the mechanical compartment and along a first portion of the freezer compartment perimeter, a second send segment routed through the mullion region, a third send segment routed along a first portion of the refrigerator compartment perimeter adjacent the mullion region, a first return segment routed along a second portion of the refrigerator compartment perimeter, a second return segment routed through the mullion region, and a third return segment routed along a second portion of the freezer compartment perimeter and to the mechanical compartment;

a condenser disposed in the mechanical compartment and coupled to the heat loop, wherein a refrigerant is directed from the compressor, through the heat loop, and then to the condenser; and an evaporator assembly coupled to the condenser and the compressor.

2. The vacuum insulated refrigerator of claim 1, wherein the second send segment of the heat loop includes a first mullion segment routed along a first mullion portion of the freezer compartment perimeter, a second mullion segment that extends from a first lateral side of the mullion region to a second lateral side of the mullion region proximate a midline between the freezer compartment and the refrigerator compartment, and a third mullion segment routed along a first mullion portion of the refrigerator compartment perimeter, and wherein the second return segment of the heat loop includes a first mullion segment routed along a second mullion portion of the refrigerator compartment perimeter, a second mullion segment that extends from the second lateral side of the mullion region to the first lateral side of the mullion region proximate the midline, and a third mullion segment routed along a second mullion portion of the freezer compartment perimeter, and further wherein the second mullion segment of the second send segment extends proximate and parallel to the second mullion segment of the second return segment.

3. The vacuum insulated refrigerator of claim 1, wherein the second send segment of the heat loop includes a first mullion segment routed along a first mullion portion of the freezer compartment perimeter, a second mullion segment that extends at an obtuse angle from a freezer side of the mullion region to a refrigerator side of the mullion region, and a third mullion segment routed along a first mullion portion of the refrigerator compartment perimeter, and wherein the second return segment of the heat loop includes a first mullion segment routed along a second mullion portion of the refrigerator compartment perimeter, a second mullion segment that extends at an obtuse angle from the refrigerator side of the mullion region to the freezer side of the mullion region, and a third mullion segment routed along a second mullion portion of the freezer compartment perimeter, and further wherein the second mullion segment of the second send segment extends proximate and parallel to the second mullion segment of the second return segment.

4. The vacuum insulated refrigerator of claim 1, wherein the refrigerant system includes a drier coupled to the condenser and the evaporator assembly.

5. The vacuum insulated refrigerator of claim 4, wherein the evaporator assembly includes:

a refrigerator evaporator assembly disposed in the refrigerator compartment; and a freezer evaporator assembly disposed in the freezer compartment, wherein the refrigerator evaporator assembly and the freezer evaporator assembly are arranged in parallel along a refrigerant flow path.

6. The vacuum insulated refrigerator of claim 5, wherein the refrigerator evaporator assembly includes a first roll bond evaporator coupled to a second roll bond evaporator, and wherein the first roll bond evaporator and the second roll bond evaporator are arranged in series along the refrigerant flow path.

7. The vacuum insulated refrigerator of claim 5, wherein the refrigerator evaporator assembly includes a wire-on-tube evaporator and the freezer evaporator assembly includes a fin-on-tube evaporator.

8. A vacuum insulated refrigerator, comprising:

a cabinet defining an upper compartment, a lower compartment, and a mullion region between the upper compartment and the lower compartment, and wherein the cabinet at least partially defines a machine compartment;

a trim breaker coupled to a periphery of the cabinet and the mullion region;

a compressor disposed in the machine compartment;

a heat loop fluidly coupled to the compressor, wherein the heat loop is coupled to the trim breaker and routed along the periphery of the cabinet and through the mullion region;

a condenser fluidly coupled to the heat loop; and an evaporator assembly fluidly coupled to the condenser and to the compressor, wherein the evaporator assembly includes:

at least one first evaporator disposed in the upper compartment; and a second evaporator disposed in the lower compartment, and wherein a refrigerant is configured to flow from the compressor to the heat loop, from the heat loop to the condenser, and from the condenser to the evaporator assembly.

9. The vacuum insulated refrigerator of claim 8, wherein the at least one first evaporator includes a first roll bond evaporator coupled to a second roll bond evaporator.

10. The vacuum insulated refrigerator of claim 8, wherein the upper compartment is a refrigeration compartment, and wherein the at least one first evaporator is a wire-on-tube evaporator.

11. The vacuum insulated refrigerator of claim 8, wherein the heat loop routed through the mullion region includes a send portion and a return portion, and wherein the send portion is routed proximate to a first mullion portion of the lower compartment, proximate to a midline between the upper compartment and the lower compartment and from a first end of the mullion region to a second end of the mullion region, and proximate to a first mullion portion of the upper compartment, and wherein the return portion is routed proximate to a second mullion portion of the upper compartment, proximate to the midline and from the second end to the first end, and proximate to a second mullion portion of the lower compartment, and further wherein the send portion routed proximate the midline extends proximate and parallel to the return portion routed proximate to the midline.

12. The vacuum insulated refrigerator of claim 8, wherein the heat loop routed through the mullion region includes a send portion and a return portion, and wherein the send portion is routed proximate to a first mullion portion of the lower compartment, from a lower side of the mullion region to an upper side of the mullion region at a first obtuse angle relative to the lower side of the mullion region, and proximate to a first mullion portion of the upper compartment, and wherein the return portion is routed proximate to a second mullion portion of the upper compartment, from the upper side to the lower side at a second obtuse angle relative to the upper side of the mullion region and proximate to a second mullion portion of the lower compartment, and further wherein the send portion extending at the first obtuse angle extends proximate to the return portion extending at the second obtuse angle.

13. The vacuum insulated refrigerator of claim 12, wherein the first obtuse angle is equal to the second obtuse angle.

14. A refrigeration appliance, comprising:

a cabinet including a wrapper and a liner, wherein the wrapper at least partially defines a machine compartment;

a trim breaker coupled to an edge of the wrapper and an edge of the liner, wherein the trim breaker defines a mullion region; and a refrigerant system, including:

a compressor disposed in the machine compartment;

a heat loop is coupled the compressor, wherein the heat loop is coupled to the trim breaker, and wherein the heat loop includes a send portion and a return portion routed through the mullion region, and further wherein the send portion and the return portion each cross a center line defined by the cabinet;

a condenser disposed in the machine compartment and coupled to the heat loop; and an evaporator assembly coupled to the cabinet.

15. The refrigeration appliance of claim 14, wherein the liner defines a refrigeration compartment and a freezer compartment, and wherein the evaporator assembly includes a wire-on-tube evaporator coupled to the liner and in the refrigeration compartment.

16. The refrigeration appliance of claim 14, wherein the liner defines a refrigeration compartment and a freezer compartment, and wherein the evaporator assembly includes a first roll bond evaporator coupled to a second roll bond evaporator, and wherein the first roll bond evaporator and the second roll bond evaporator are arranged in series along a flow path of a refrigerant and are coupled to the liner in the refrigeration compartment.

17. The refrigeration appliance of claim 14, wherein the heat loop is disposed between the compressor and the condenser, and wherein the refrigerant system is configured to direct a refrigerant along a flow path from the compressor to the heat loop, from the heat loop to the condenser, and through the evaporator assembly to the compressor.

18. The refrigeration appliance of claim 14, wherein the cabinet defines a first compartment, a second compartment, and defines the mullion region between the first compartment and the second compartment, and wherein the heat loop is routed along a perimeter of the first compartment, a perimeter of the second compartment, and through the mullion region between the first compartment and the second compartment.

19. The refrigeration appliance of claim 18, wherein the send portion is routed proximate to a first mullion portion of the first compartment, proximate to a midline between the first compartment and the second compartment and from a first end of the mullion region to a second end of the mullion region, and proximate to a first mullion portion of the second compartment, and wherein the return portion is routed proximate to a second mullion portion of the second compartment, proximate to the midline and from the second end to the first end, and proximate to a second mullion portion of the first compartment, and wherein the send portion routed proximate the midline extends proximate and parallel to the return portion routed proximate to the midline.

20. The refrigeration appliance of claim 18, wherein the send portion is routed proximate to a first mullion portion of the first compartment, from a lower side of the mullion region to an upper side of the mullion region at a first obtuse angle relative to the lower side of the mullion region, and proximate to a first mullion portion of the second compartment, and wherein the return portion is routed proximate to a second mullion portion of the second compartment, from the upper side to the first side at a second obtuse angle relative to the upper side of the mullion region and proximate to a second mullion portion of the first compartment, and wherein the send portion extending at the first obtuse angle extends parallel and proximate to the return portion extending at the second obtuse angle.

* * * * *